US008943764B1

(12) United States Patent
Averitt

(10) Patent No.: US 8,943,764 B1
(45) Date of Patent: Feb. 3, 2015

(54) ADJUSTABLE SKIRTING FRAME

(71) Applicant: Randal K. Averitt, Hosston, LA (US)

(72) Inventor: Randal K. Averitt, Hosston, LA (US)

( * ) Notice: Subject to any disclaimer, the term of this patent is extended or adjusted under 35 U.S.C. 154(b) by 0 days.

(21) Appl. No.: 13/828,433

(22) Filed: Mar. 14, 2013

(51) Int. Cl.
*E04B 1/343* (2006.01)
*E04H 12/18* (2006.01)

(52) U.S. Cl.
CPC . *E04B 1/343* (2013.01); *Y10S 52/03* (2013.01)
USPC ..... 52/169.12; 52/646; 52/DIG. 3

(58) Field of Classification Search
CPC ..... E04B 1/34342; Y10S 52/03
USPC ..... 52/169.12, DIG. 3, 645, 646, 235
See application file for complete search history.

(56) References Cited

U.S. PATENT DOCUMENTS

| | | | | | |
|---|---|---|---|---|---|
| 3,710,525 | A * | 1/1973 | Lopes | 52/169.12 |
| 3,775,917 | A * | 12/1973 | Struben | 52/169.12 |
| 3,803,781 | A * | 4/1974 | Struben | 52/149 |
| 4,112,638 | A | 9/1978 | Hanson, Sr. | |
| 4,212,486 | A | 7/1980 | Logsdon | |
| 4,261,598 | A | 4/1981 | Cornwall | |
| 4,417,426 | A | 11/1983 | Meng | |
| 4,680,904 | A * | 7/1987 | Stoecker | 52/169.12 |
| 4,918,761 | A | 4/1990 | Harbeke | |
| 5,090,739 | A | 2/1992 | Pollard | |
| 5,190,320 | A | 3/1993 | Hodges | |
| 5,359,821 | A | 11/1994 | Merriman | |
| 5,515,655 | A | 5/1996 | Hoffmann | |
| 5,735,100 | A * | 4/1998 | Campbell | 52/645 |
| 5,927,038 | A * | 7/1999 | Goldberg et al. | 52/632 |
| 5,996,134 | A | 12/1999 | Snninger | |
| 6,254,141 | B1 | 7/2001 | Piper | |
| 6,374,552 | B1 * | 4/2002 | Price | 52/169.12 |
| 6,443,495 | B1 | 9/2002 | Harmeling | |
| 6,453,627 | B1 * | 9/2002 | Powers | 52/169.12 |
| 6,591,849 | B1 | 7/2003 | Swetish et al. | |
| 6,883,187 | B2 | 4/2005 | Cornwall | |
| 7,160,000 | B2 | 1/2007 | Eldridge et al. | |
| 8,756,878 | B1 * | 6/2014 | Powell | 52/169.12 |
| 2001/0009084 | A1 * | 7/2001 | Wolfrum | 52/169.12 |
| 2003/0188497 | A1 * | 10/2003 | Price | 52/169.12 |
| 2010/0037537 | A1 | 2/2010 | Lee | |
| 2010/0199576 | A1 * | 8/2010 | Farrell et al. | 52/169.12 |
| 2013/0255178 | A1 * | 10/2013 | Judd | 52/646 |

* cited by examiner

*Primary Examiner* — Ryan Kwiecinski
(74) *Attorney, Agent, or Firm* — R. Keith Harrison

(57) ABSTRACT

An adjustable skirting frame includes a first frame rail; a second frame rail disposed in spaced-apart, parallel relationship to the first frame rail; a plurality of spaced-apart, parallel, length-adjustable studs pivotally carried by and extending between the first frame rail and the second frame rail; a plurality of center supports extending between adjacent pairs, respectively, of the plurality of length-adjustable studs; and a plurality of panel mounting spaces formed by and between the first frame rail, the second frame rail, the plurality of length-adjustable studs and the plurality of center supports.

17 Claims, 8 Drawing Sheets

ADJUSTABLE SKIRTING FRAME

CROSS-REFERENCE TO RELATED APPLICATIONS

This application claims the benefit of U.S. provisional application No. 61/685,238, filed Mar. 14, 2012 and entitled ADJUSTABLE SKIRTING FRAME, which provisional application is incorporated by reference herein in its entirety.

FIELD

Illustrative embodiments of the disclosure generally relate to walls and skirting systems for structures such as elevated homes and other buildings. More particularly, illustrative embodiments of the disclosure relate to adjustable skirting frame which is lightweight, has a compact packaging configuration and is adjustable in size to support skirting panels in a decorative skirting system on an elevated structure.

BACKGROUND

Elevated structures are structures which, rather than resting directly on a foundation, are spaced from the ground by pylons or supports intermittently spaced around the perimeter of the structure. Common types of elevated structures include mobile homes and manufactured houses, for example. In such elevated structures, a vertical gap separates the elevated floor of the structure from the ground. This gap frequently imparts an unsightly appearance to the structure. In many cases, therefore, it is desirable to provide a decorative structure to span the gap between the ground and the floor of the elevated structure.

Various types of structures are known for spanning a vertical gap between the ground and the raised floor of an elevated structure. A skirting system typically includes a frame which spans the gap between the ground and the raised floor of the elevated structure. Multiple, adjacent skirting panels are supported by the frame. The skirting panels may be concrete or other material on which a selected decorative impression or pattern has been made. The skirting panels improve the aesthetic appearance of the elevated structure.

There is a need for an adjustable skirting frame which is lightweight, has a compact packaging configuration and is adjustable in size to support skirting panels in a skirting system on an elevated structure.

SUMMARY

Illustrative embodiments of the disclosure are generally directed to an adjustable skirting frame for a skirting system on an elevated structure. The adjustable skirting frame includes a first frame rail; a second flame rail disposed in spaced-apart, parallel relationship to the first frame rail; a plurality of spaced-apart, parallel, length-adjustable studs pivotally carried by and extending between the first frame rail and the second frame rail; a plurality of center supports extending between adjacent pairs, respectively, of the plurality of length-adjustable studs; and a plurality of panel mounting spaces formed by and between the first frame rail, the second frame rail, the plurality of length-adjustable studs and the plurality of center supports.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable users skilled in the art to practice the disclosure and are not intended to limit the scope of the claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description.

Figure 1:
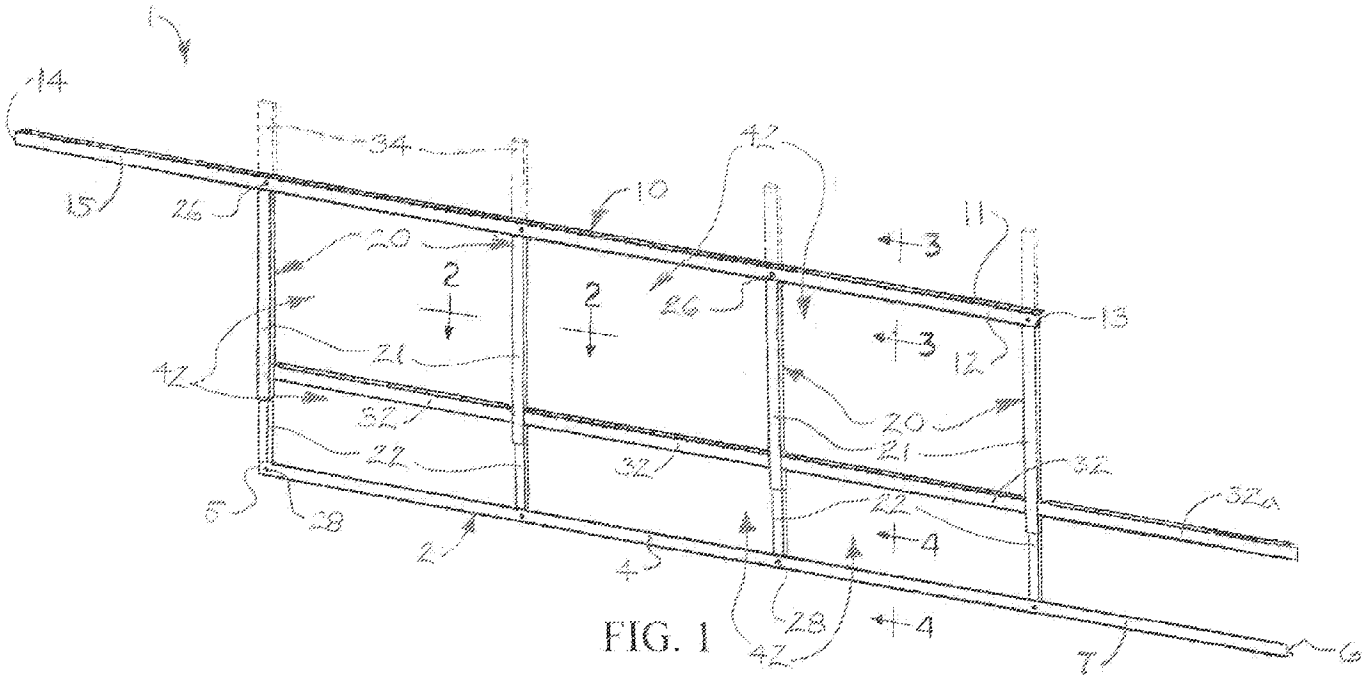
FIG. 1 is a front perspective view of an illustrative embodiment of the adjustable skirting frame.
Figure 2:
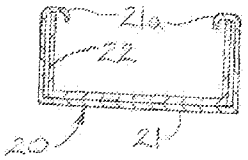
FIG. 2 is a cross-sectional view, taken along section lines 2-2 in FIG. 1, of an exemplary adjustable stud component of the illustrative adjustable skirting frame.
Figure 3:
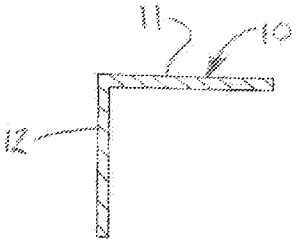
FIG. 3 is a cross-sectional view, taken along section lines 3-3 in FIG. 1, of an exemplary top frame rail component of the illustrative adjustable skirting frame.
Figure 4:
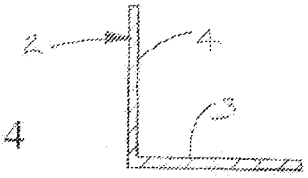
FIG. 4 is a cross-sectional view, taken along section lines 4-4 in FIG. 1, of an exemplary bottom frame rail component of the illustrative adjustable skirting frame.
Figure 5:
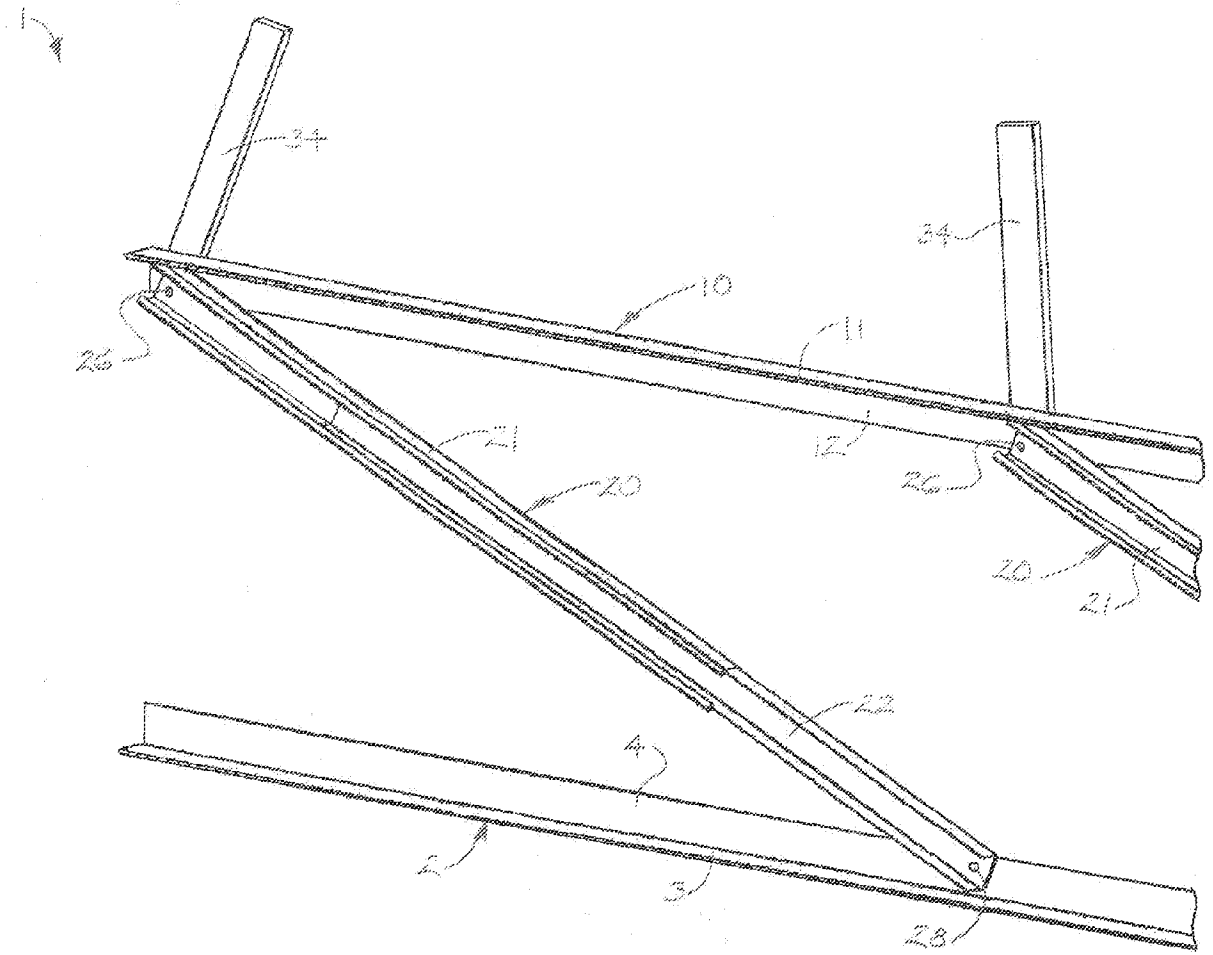
FIG. 5 is an enlarged perspective view of a section of the illustrative adjustable skirting frame.
Figure 8:
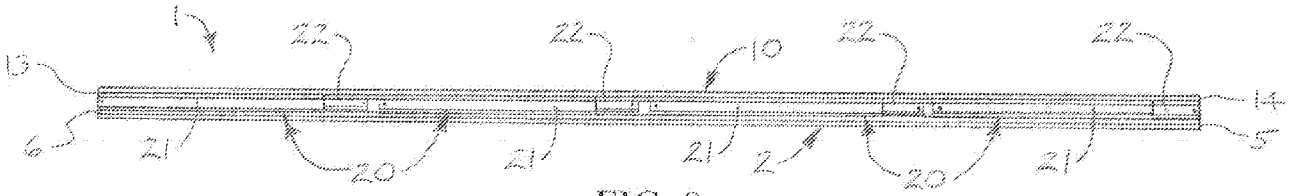
FIG. 8 is a rear view of the illustrative adjustable skirting frame deployed in a collapsed packaging configuration.
Figure 9:
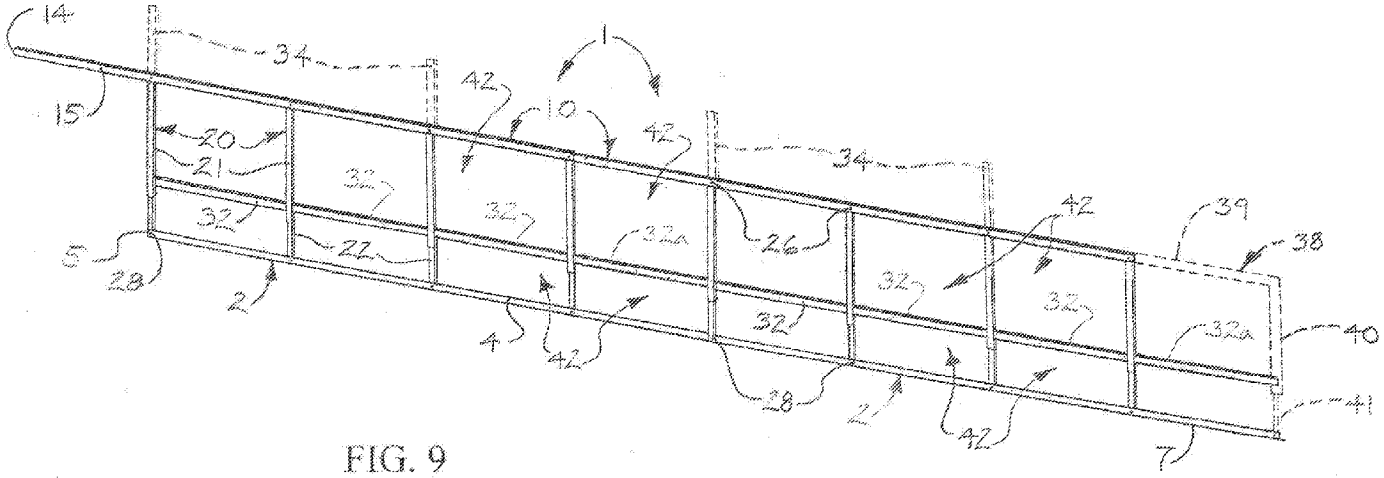
FIG. 9 is a perspective view of a pair of adjustable skirting frames attached to each other in end-to-end relationship.
Figure 10A:
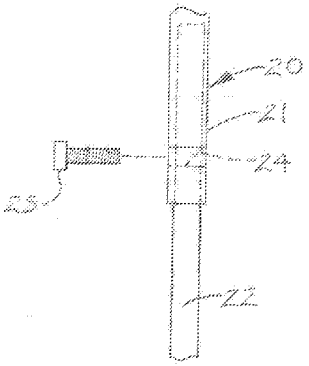
FIG. 10A is a side view of an adjustable stud of the adjustable skirting frame, more particularly illustrating an exemplary technique for securing the selected height of the adjustable skirting frame.
Figure 10:
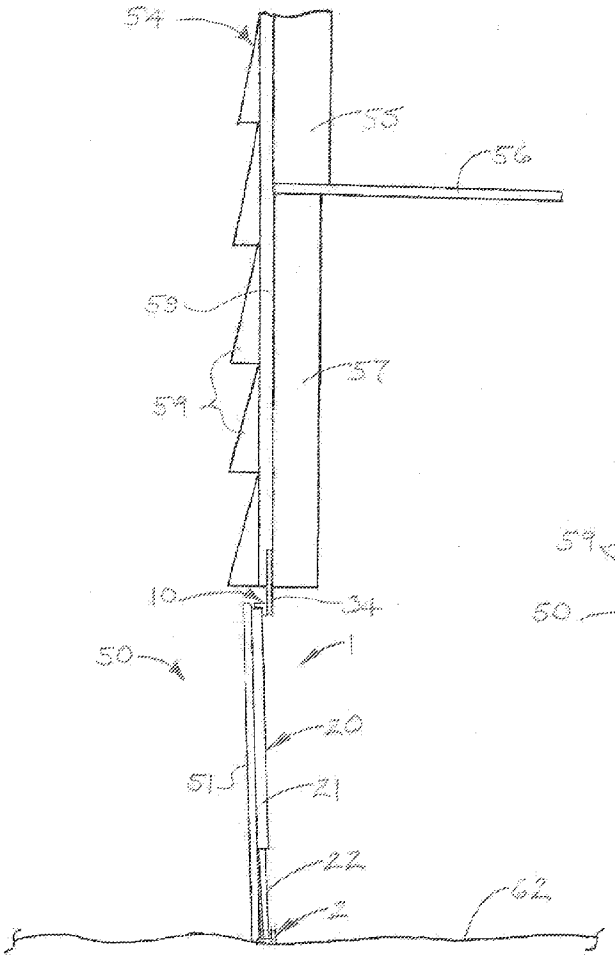
FIG. 10 is a cross-sectional view of an exterior of an elevated structure and an illustrative embodiment of the skirting panel assembly deployed between the ground and the bottom of the elevated structure.

Referring initially to FIGS. 1-10 of the drawings, an illustrative embodiment of an adjustable skirting frame is generally indicated by reference numeral 1. As illustrated in FIG. 10, in exemplary application of the adjustable skirting frames 1, which will be hereinafter described, multiple adjustable skirting frames 1 may be attached to each other in end-to-end relationship in assembly of a skirting system 50 (FIG. 10) between the ground 62 and an elevated structure 54. The skirting system 50 enhances the aesthetic appearance of the elevated structure 54. The adjustable skirting frame 1 includes a bottom frame rail 2 and a top frame rail 10 disposed generally parallel to the bottom frame rail 2. As illustrated in FIG. 4, in some embodiments, the bottom frame rail 2 may include an elongated angle beam with a base rail segment 3 and an attachment rail segment 4 disposed at a 90-degree angle to the base rail segment 3. As illustrated in FIG. 3, in some embodiments, the top frame rail 10 may include an elongated angle beam with a cap rail segment 11 and an attachment rail segment 12 disposed at a 90-degree angle to the cap rail segment 11. The bottom frame rail 2 may have a first bottom frame rail end 5 and a second bottom frame rail end 6. The top frame rail 10 may have a first top frame rail end 13 and a second top frame rail end 14.

Multiple adjustable studs 20 extend between the bottom frame rail 2 and the top frame rail 10 in generally parallel, spaced-apart relationship to each other. Each adjustable stud 20 is adjustable in length between the bottom frame rail 2 and the top frame rail 10. In some embodiments, each adjustable stud 20 may have a telescopic construction with a stud leg receptacle 21 and a stud leg 22 which is telescopically extendable from and retractable into the stud leg receptacle 21. As illustrated in FIG. 2, the stud leg receptacle 21 may have a generally U-shaped channel beam cross-section with a pair of facing receptacle flanges 21*a*. The stud leg 22 may likewise have a U-shaped channel beam cross-section and is slidably disposed inside the stud leg receptacle 21. The stud leg receptacle 21 of each adjustable stud 20 is pivotally attached to a first one of the bottom frame rail 2 and the top frame rail 10. The stud leg 22 of each adjustable stud 20 is pivotally attached to a second one of the bottom frame rail 2 and the top frame rail 10. As illustrated in FIG. 1, in some embodiments, the stud leg receptacle 21 of each adjustable stud 20 is pivotally attached to the attachment rail segment 12 of the top frame rail 10 via a receptacle pivot 26. The stud leg 22 of each adjustable stud 20 is pivotally attached to the attachment rail segment 4 of the bottom frame rail 2 via an arm pivot 28. In other embodiments, the stud leg receptacle 21 may be pivotally attached to the bottom frame rail 2 and the stud leg 22 may be pivotally attached to the top frame rail 10. As illustrated in FIG. 1, in some embodiments, the bottom frame rail 2 may have a bottom protruding rail segment 7 which extends beyond the adjustable studs 20 on a first side of the adjustable skirting frame 1. The second bottom frame rail end 6 may terminate the bottom protruding rail segment 7. The top frame rail 10 may have a top protruding rail segment 15 which extends beyond the adjustable studs 20 on a second side side of the adjustable skirting frame 1. The second top frame rail end 14 may terminate the top protruding rail segment 15.

Figure 6:
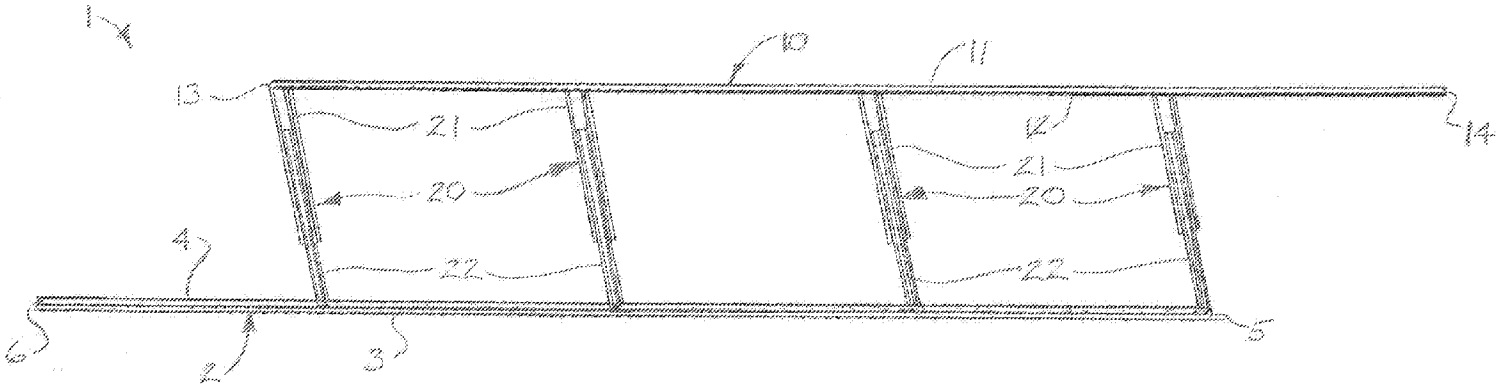
FIG. 6 is a rear perspective view of the illustrative adjustable skirting frame deployed in an extended, functional configuration.
Figure 7:
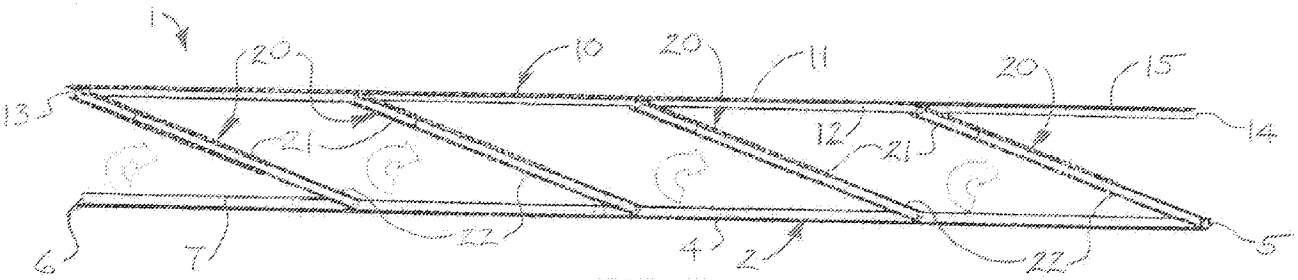
FIG. 7 is a rear perspective view of the illustrative adjustable skirting frame deployed in a partially-collapsed configuration.

The adjustable skirting frame 1 can be selectively deployed between an extended, functional configuration as illustrated in FIGS. 1 and 6, in which the adjustable studs 20 are disposed in perpendicular relationship to the longitudinal axes of the bottom frame rail 2 and the top frame rail 10, and a collapsed packaging configuration as illustrated in FIG. 8, in which the adjustable studs 20 are co-linear and lie between the bottom frame rail 2 and the top frame rail 10. The collapsed packaging configuration of the adjustable skirting frame 1 facilitates ease in transport of the adjustable skirting frame 1 from a transporting vehicle (not illustrated) to an installation site, as will be hereinafter further described.

As illustrated in FIG. 1, in some embodiments, center supports 32 may be provided between the adjacent adjustable studs 20 for structural stabilization purposes. The opposite ends of each center support 32 may be attached to the stud leg receptacles 21 of the respective adjacent adjustable studs 20 using mechanical fasteners (not illustrated) or the like. A terminal center support 32*a* may extend from an adjustable stud 20 in spaced-apart, parallel, adjacent relationship to the bottom protruding rail segment 7. Panel mounting spaces 42 may be formed by and between the bottom frame rail 2, the adjustable studs 20, the top frame rail 10 and the center supports 32. The purpose of the panel mounting spaces 42 will be hereinafter described.

As further illustrated in FIG. 1, in some embodiments, at least one generally elongated frame attachment member 34 may extend from the top frame rail 10. Multiple frame attachment members 34 may be pivotally attached to the top frame rail 10 at the respective receptacle pivots 26. The purpose of the frame attachment members 34 will be hereinafter described.

Figure 9A:
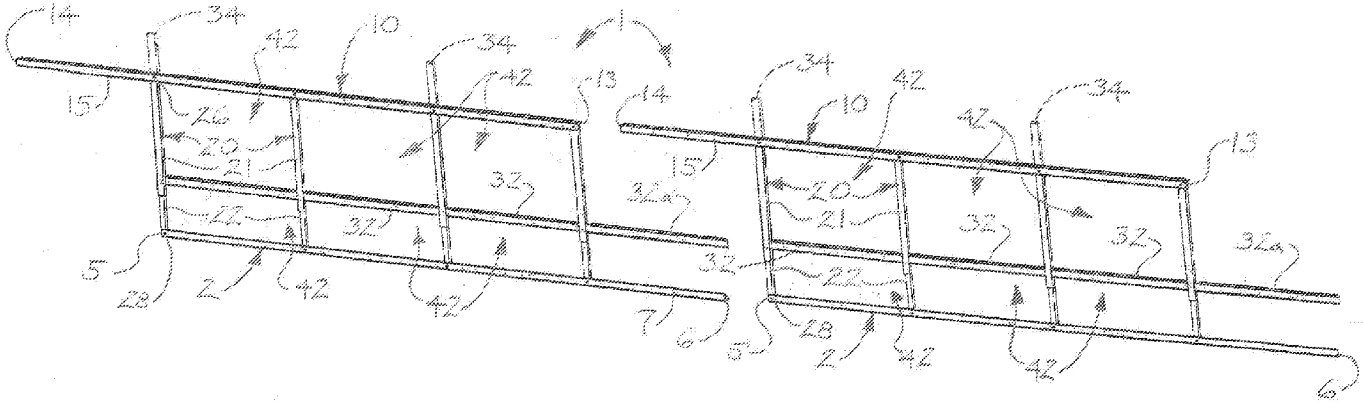
FIG. 9A is a perspective view of a pair of adjacent adjustable skirting frames detached from each other.

As illustrated in FIGS. 9 and 9A, in exemplary application, as will be hereinafter described, multiple adjustable skirting frames 1 can be attached in end-to-end relationship to each other depending on the desired size of a skirting system 50 (FIG. 10) which is to be assembled using the adjustable skirting frames 1. Accordingly, as illustrated in FIG. 9A, the second top frame rail end 14 of a second adjustable skirting frame 1 may be attached to the facing first top frame rail end 13 of an adjacent first adjustable skirting frame 1. Likewise, the first bottom frame rail end 5 of the second adjustable skirting frame 1 may be attached to the facing second bottom frame rail end 6 of the adjacent first adjustable skirting frame 1. Attachment of the adjustable skirting frames 1 to each other may be carried out using mechanical fasteners (not illustrated) and/or other suitable attachment technique which is known by those skilled in the art. In similar manner, additional adjustable skirting frames 1 can be attached to each other in end-to-end relationship to form the skirting system 50 (FIG. 10).

As further illustrated in FIG. 9, in applications in which a terminal adjustable skirting frame 1 at the end of a series of connected adjustable skirting frames 1 remains unconnected to additional adjustable skirting frames 1, a frame cap 38 may be provided on the terminal adjustable skirting frame 1. The frame cap 38 may include a horizontal frame cap segment 39 which may be attached to the first top frame rail end 13 of the top frame rail 10 using mechanical fasteners (not illustrated) and/or other suitable attachment technique known by those skilled in the art. A frame cap stud receptacle 40 may extend downwardly from the horizontal frame cap segment 39. A frame cap stud leg 41 may be telescopically or otherwise adjustable with respect to the frame cap stud receptacle 40. The frame cap stud leg 41 may be attached to the bottom frame rail 2 via an arm pivot 28. Accordingly, the frame cap 38 may be used to complete the ends of the assembled and connected adjustable skirting frames 1 at respective corners of the elevated structure 54 and/or provide a suitable attachment structure for attachment of an adjacent adjustable skirting frame 1 at each corner of the elevated structure 54.

Figure 11:
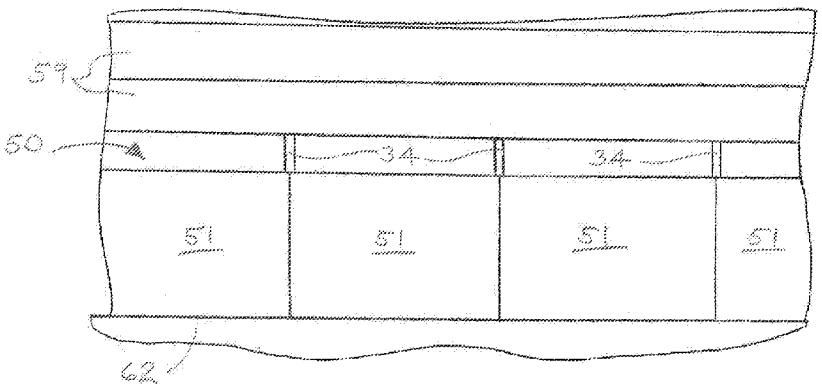
FIG. 11 is an exterior of the elevated structure (partially in section) illustrated in FIG. 10 and a portion of the illustrative skirting panel assembly.

Referring next to FIGS. 10, 10A and 11 of the drawings, in exemplary application, multiple adjustable skirting frames 1 are used to assemble a skirting system 50 between the ground 62 and an elevated structure 54. The elevated structure 54 may be a mobile home or manufactured housing, for example and without limitation. Generally, the elevated structure 54 may include multiple vertical, parallel, spaced-apart wall studs 55; floor decking 56 supported by the wall studs 55; a sill 57 extending beneath the floor decking 56; a wall sheathing 58 exterior to the sill 57; and siding 59 on the exterior of the wall sheathing 58. The adjustable skirting frames 1 may be non-load-bearing and support multiple skirting panels 51 to enhance the aesthetic appearance of the elevated structure 54.

Multiple adjustable skirting frames 1 may each be packaged in a collapsed packaged configuration as illustrated in FIG. 8. The compact configuration of the collapsed adjustable skirting frames 1 may render the adjustable skirting frames 1 amenable to being easily carried in large quantities from a transporting vehicle (not illustrated) to the elevated structure 54 where the skirting system 50 will be installed.

Each adjustable skirting frame 1 is deployed from the collapsed packaging configuration illustrated in FIG. 8 to the expanded, functional configuration illustrated in FIGS. 1 and 6 by pivoting the adjustable studs 20 at the bottom frame rail 2 via the respective arm pivots 28 and at the top rail 10 via the respective receptacle pivots 26. The height of each adjustable skirting frame 1 may be selected by selecting the height of the adjustable studs 20 in the adjustable skirting frame 1. The height of each adjustable stud 20 can be selected by sliding the stud leg 22 relative to the stud leg receptacle 21. As illustrated in FIG. 10, the height of the adjustable skirting frame 1 may be selected such that the adjustable skirting frame 1 covers the gap between the ground 62 and the bottom of the elevated structure 54. As illustrated in FIG. 10A, the selected length of each adjustable stud 20 may be secured such as by extending a mechanical stud fastener 23 through registering stud fastener openings 24 in the stud leg receptacle 21 and the stud leg 22, respectively, for example and without limitation. It will be appreciated by those skilled in the art that the heights of the adjustable studs 20 on each adjustable skirting frame 1 can be individually and independently selected to accord with irregularities or unevenness in the ground 62 beneath the elevated structure 54.

As illustrated in FIGS. 10 and 11, each expanded or deployed adjustable skirting frame 1 is deployed in a vertical position with the bottom frame rail 2 resting on the ground 62 and the top frame rail 10 extending beneath and parallel to the sill 57 of the elevated structure 54. Adjacent adjustable skirting frames 1 may be attached to each other in end-to-end relationship as was heretofore described with respect to FIGS. 9 and 9A. In some embodiments, the frame attachment members 34 which extend from the top frame rail 10 may be used to secure the adjustable skirting frames 1 to the elevated structure 54. Accordingly, as illustrated in FIG. 10, in some applications, each frame attachment member 34 may be inserted between the sill 57 and the wall sheathing 58 of the elevated structure 54. The frame attachment members 34 may or may not be additionally attached to the elevated structure 54 using mechanical fasteners (not illustrated) or other suitable attachment technique known by those skilled in the art.

Multiple skirting panels 51 are attached to each adjustable skirting frame 1. In some embodiments, each skirting panel 51 may generally occupy a corresponding panel mounting space 42 (FIG. 1) in the adjustable skirting frame 1. Each skirting panel 51 may include a support panel, a bond coat applied to the support panel and a decorative overlay (not illustrated) which is spread, poured, sprayed, stamped or otherwise applied on or to the bond coat. The decorative overlay is a material which is initially impressionable when applied to the bond coat and subsequently hardens or cures. A suitable example of the decorative overlay is a cementitious material. Alter the decorative overlay is applied to the bond coat and while the decorative overlay is still impressionable, any of various decorative design textures, such as those simulating the appearance of bricks, natural stones, rocks, wood or other structural elements, for example and without limitation, may be pressed, stamped or otherwise forged into the decorative overlay using techniques which are known by those skilled in the art. The decorative overlay then cures or hardens such that the forged designs remain therein. The decorative overlay may alternatively or additionally be painted or otherwise colored according to the aesthetic desires of the user, after which a sealant (not illustrated) is typically applied to the decorative overlay. The decorative overlay may be applied to the support panel and the designs formed in the decorative overlay on-site where the skirting system 50 is assembled. Alternatively, the skirting panels 51 may be pre-fabricated, the decorative overlay impressed and/or colored and sealed and then the skirting panels 51 transported to the installation site with the folded or collapsed adjustable skirting frames 1. Each skirting panel 51 may be attached to the adjustable skirting frame 1 using mechanical fasteners (not illustrated) according to the knowledge of those skilled in the art.

Figure 13:
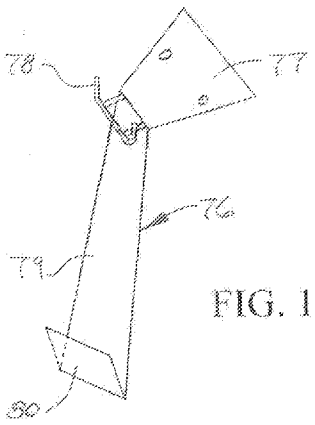
FIG. 13 is a perspective view of an exemplary Anchor hook of the illustrative skirting panel assembly illustrated in FIG. 12.
Figure 14:
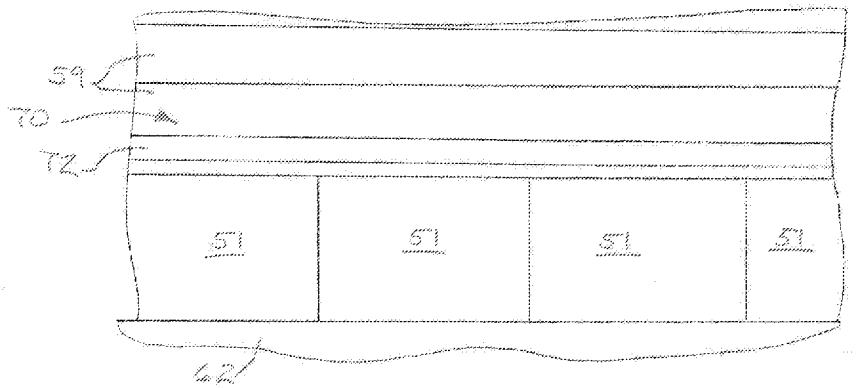
FIG. 14 is an exterior of the elevated structure (partially in section) and a portion of the illustrative skirting panel assembly illustrated in FIG. 12.
Figure 12:
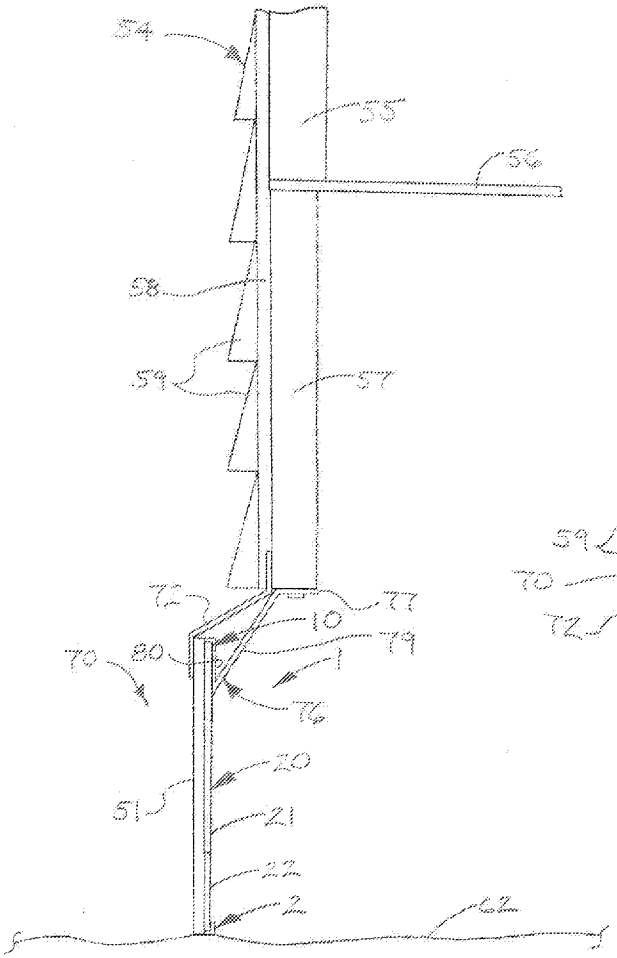
FIG. 12 is a cross-sectional view of an exterior of an elevated structure and an alternative illustrative embodiment of the skirting panel assembly deployed between the ground and the bottom of the elevated structure.

Referring next to FIGS. 12-14 of the drawings, an alternative illustrative embodiment of a skirting system 70 which utilizes multiple adjustable skirting frames 1 is illustrated. A top cap 72 may be inserted between the sill 57 and the wall sheathing 58 of the elevated structure 54 and secured to the skirting panel 51 of the skirting system 70 using mechanical fasteners (not illustrated) and/or other suitable attachment technique known by those skilled in the art. Multiple anchor hooks 76 may be deployed between the elevated structure 54 and the skirting system 70, behind the top cap 72, for reinforcement purposes. As illustrated in FIG. 13, each anchor hook 76 may include a hook attachment flange 77 which is attached to the sill 57 or other component of the elevated structure 54 using mechanical fasteners and/or other suitable attachment technique. An elongated hook shaft 79 extends from the hook attachment flange 77. A shaft flange 80 terminates the hook shaft 79. The shaft flange 80 may be attached to the top frame rail 10 or other component of the adjustable skirting frame 1 using mechanical fasteners (not illustrated) and/or other suitable attachment technique. A top cap hook 78 may be provided at the junction between the hook attachment flange 77 and the hook shaft 79. The top cap hook 78 may engage the top cap 72 when the anchor hook 76 is deployed in place as illustrated in FIG. 12. Accordingly, the anchor hooks 76 reinforce the skirting system 70 against wind loads and the like.

Figure 15A:
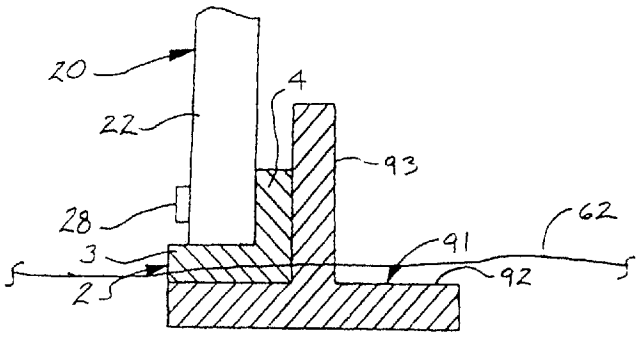
FIG. 15A is a cross-sectional view of an anchor rail and the adjustable skirting frame attached to the anchor rail according to the illustrative embodiment of the skirting panel assembly illustrated in FIG. 15.
Figure 16:
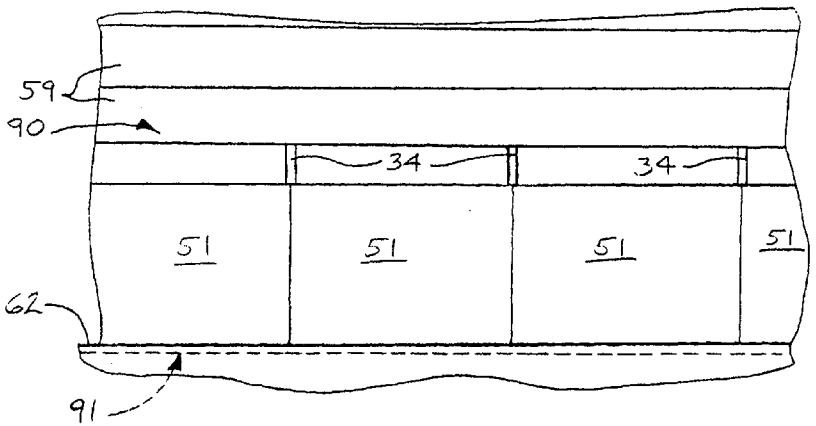
FIG. 16 is an exterior of the elevated structure (partially in section) and a portion of the illustrative skirting panel assembly illustrated in FIG. 15.
Figure 15:
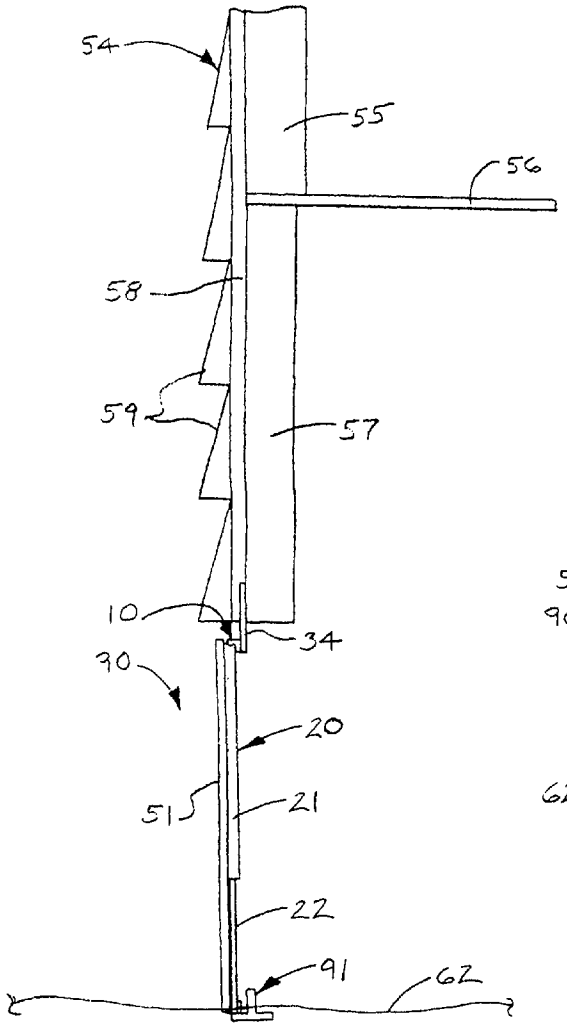
FIG. 15 is a cross-sectional view of an exterior of an elevated structure and another alternative illustrative embodiment of the skirting panel assembly deployed between the ground and the bottom of the elevated structure.

Referring next to FIGS. 15, 15A and 16 of the drawings, an alternative illustrative embodiment of a skirting system 90 which utilizes multiple adjustable skirting frames 1 is illustrated. An anchor rail 91 may be deployed in the ground 62 and the bottom frame rail 2 of the adjustable skirting frame 1 attached to the anchor rail 91 for reinforcement purposes. As illustrated in FIG. 15A, the anchor rail 91 may include a flat anchor rail base 92. Anchor rail webbing 93 may extend from the anchor rail base 92. The anchor rail base 92 is covered by the ground 62, and the anchor rail webbing 93 extends upwardly through the ground 62. The bottom frame rail 2 of the adjustable skirting frame 1 is attached to the anchor rail base 92 and/or the anchor rail webbing 93. Accordingly, the anchor rail 91 anchors the adjustable skirting frame 1 in the ground 62 and reinforces the skirting system 90 against wind loads and the like.

Figure 17:
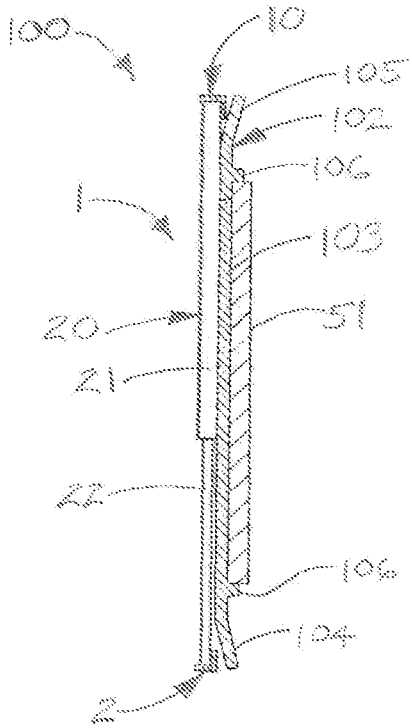
FIG. 17 is a sectional view of another alternative illustrative embodiment of a skirting panel assembly.

Referring next to FIG. 17 of the drawings, another alternative illustrative embodiment of a skirting system 100 which utilizes multiple adjustable skirting frames 1 is illustrated. A panel mounting member 102 may be attached to each adjustable stud 20 using mechanical fasteners (not illustrated) and/or other suitable attachment technique. The panel mounting member 102 may include a generally flat or planar main panel 103. A bottom flange 104 and a top flange 105 may extend from lower and upper edges, respectively, of the main panel 103. A pair of spaced-apart, upper and lower panel retaining ridges 106 may protrude from the main panel 103. Multiple skirting panels 51 may be inserted between the panel retaining ridges 106 in adjacent, end-to-end relationship to each other. The skirting panels 51 may be secured between the panel retaining ridges 106 via a friction fit. The skirting panels 51 may be additionally secured to the main panel 103 via mechanical fasteners (not illustrated) and/or other suitable attachment technique. The panel mounting members 102 may structurally reinforce the adjustable skirting frame 1 as well as provide a structure for attachment of the skirting panels 51 to each other in the skirting panel assembly 100.

While the illustrative embodiments of the disclosure have been described above, it will be recognized and understood that various modifications can be made in the disclosure and the appended claims are intended to cover all such modifications which may fall within the spirit and scope of the disclosure.

What is claimed is:

1. An adjustable skirting frame for a skirting system on an elevated structure, comprising:

a first frame rail;

a second frame rail disposed in spaced-apart, parallel relationship to the first frame rail;

a plurality of spaced-apart, parallel, length-adjustable studs pivotally carried by and extending between the first frame rail and the second frame rail;

a plurality of center supports extending between adjacent pairs, respectively, of the plurality of length adjustable studs;

a plurality of panel mounting spaces formed by and between the first frame rail, the second frame rail, the plurality of length-adjustable studs and the plurality of center supports; and a plurality of elongated, straight, linear frame attachment members pivotally carried by the second frame rail, the frame attachment members substantially co-linear with the plurality of length-adjustable studs, respectively, and protruding beyond the second frame rail opposite the plurality of length-adjustable studs, respectively, and adapted for insertion between a sill and a wall sheathing of the elevated structure.

2. The adjustable skirting frame of claim 1 wherein each of the plurality of length-adjustable studs is telescopically adjustable.

3. The adjustable skirting frame of claim 2 wherein each of the plurality of length-adjustable studs comprises a stud leg receptacle carried by the first frame rail and a stud leg telescopically extendable from the stud leg receptacle, the stud leg carried by the second frame rail.

4. The adjustable skirting frame of claim 3 wherein each of the stud leg receptacle and the stud leg has a generally U-shaped cross-section.

5. The adjustable skirting frame of claim 1 further comprising a plurality of anchor hooks engaging at least one of the first frame rail, the second frame rail, the plurality of length-adjustable studs and the plurality of center supports.

6. The adjustable skirting frame of claim 5 wherein each of the plurality of anchor hooks comprises a hook attachment flange, a hook shaft carried by the hook attachment flange and a shaft flange carried by the hook shaft, the shaft flange engaging the second frame rail.

7. The adjustable skirting frame of claim 1 further comprising an anchor rail and wherein the first frame rail is carried by the anchor rail.

8. An adjustable skirting frame for a skirting system on an elevated structure, comprising:

a first frame rail;

a second frame rail disposed in spaced-apart, parallel relationship to the first frame rail;

a plurality of spaced-apart, parallel, length-adjustable studs pivotally carried by and extending between the first frame rail and the second frame rail;

an elongated first protruding rail segment extending from the first frame rail beyond the plurality of length-adjustable studs on a first side of the adjustable skirting frame;

an elongated second protruding rail segment extending from the second frame rail beyond the plurality of length-adjustable studs on a second side of the adjustable skirting frame;

a plurality of panel mounting spaces formed by and between the first frame rail, the second frame rail, and the plurality of length-adjustable studs;

at least one skirting panel carried by the first frame rail, the second frame rail and the plurality of length-adjustable studs;

a top cap carried by the at least one skirting panel, the top cap adapted for attachment to the elevated structure; and at least one anchor hook including:

a hook attachment flange adapted for attachment to the elevated structure;

an elongated hook shaft extending from the hook attachment flange;

a shaft flange terminating the hook shaft, the shaft flange attached to the second frame rail; and a top cap hook provided at a junction between the hook attachment flange and the hook shaft, the top cap hook engaging the top cap.

9. The adjustable skirting frame of claim 8 further comprising at least one frame attachment member pivotally carried by the second frame rail.

10. The adjustable skirting frame of claim 8 wherein each of the plurality of length-adjustable studs is telescopically adjustable.

11. The adjustable skirting frame of claim 10 wherein each of the plurality of length-adjustable studs comprises a stud leg receptacle carried by the first frame rail and a stud leg telescopically extendable from the stud leg receptacle, the stud leg carried by the second frame rail.

12. The adjustable skirting frame of claim 11, wherein each of the stud leg receptacle and the stud leg has a generally U-shaped cross-section.

13. The adjustable skirting frame of claim 8 further comprising an anchor rail and wherein the first frame rail is carried by the anchor rail.

14. A non load-bearing adjustable skirting frame for a skirting system on an elevated structure, comprising:

a first frame rail;

a second frame rail disposed in spaced-apart, parallel relationship to the first frame rail;

a plurality of spaced-apart, parallel, length-adjustable studs pivotally carried by and extending between the first frame rail and the second frame rail;

an elongated first protruding rail segment extending from the first frame rail beyond the plurality of length-adjustable studs on a first side of the adjustable skirting frame;

an elongated second protruding rail segment extending from the second frame rail beyond the plurality of length-adjustable studs on a second side of the adjustable skirting frame;

a plurality of center supports extending between adjacent pairs, respectively, of the plurality of length-adjustable studs;

a plurality of panel mounting spaces formed by and between the first frame rail, the second frame rail, the plurality of length-adjustable studs and the plurality of center supports;

at least one skirting panel carried by the first frame rail, the second frame rail and the plurality of length-adjustable studs;

a top cap carried by the at least one skirting panel, the top cap adapted for attachment to the elevated structure; and at least one anchor hook including:

a hook attachment flange adapted for attachment to the elevated structure;

an elongated hook shaft extending from the hook attachment flange;

a shaft flange terminating the hook shaft, the shaft flange attached to the second frame rail; and a top cap hook provided at a junction between the hook attachment flange and the hook shaft, the top cap hook engaging the top cap.

15. The adjustable skirting frame of claim 14 further comprising at least one frame attachment member pivotally carried by the second frame rail.

16. The adjustable skirting frame of claim 14 further comprising a panel mounting member carried by the plurality of length-adjustable studs, the panel mounting member including a main panel; a first panel retaining ridge carried by the main panel; and a second panel retaining ridge carried by the main panel in spaced-apart relationship to the first panel retaining ridge; and at least one skirting panel inserted between the first panel retaining ridge and the second panel retaining ridge.

17. The adjustable skirting frame of claim 14 further comprising an anchor rail and wherein the first frame rail is carried by the anchor rail.

* * * * *